US005399135A

United States Patent [19]

Azzouni

[11] Patent Number: 5,399,135

[45] Date of Patent: Mar. 21, 1995

[54] FOREARM WORKOUT BAR

[76] Inventor: Paul Azzouni, 8208 Lesley La., Watauga, Tex. 76148-1118

[21] Appl. No.: 174,979

[22] Filed: Dec. 29, 1993

[51] Int. Cl.[6] ..... A63B 21/075

[52] U.S. Cl. ..... 482/106; 482/109

[58] Field of Search ..... 482/93, 105–109

[56] References Cited

U.S. PATENT DOCUMENTS

| | | | |
|---|---|---|---|
| 1,013,782 | 1/1912 | Koch | 482/108 |
| 3,351,346 | 11/1967 | Strahan | 482/109 X |
| 3,468,534 | 9/1969 | Donato | 482/93 X |
| 4,288,073 | 9/1981 | Petrachonis et al. | 482/106 |
| 4,361,324 | 11/1982 | Baroi | 482/106 X |
| 4,537,394 | 8/1985 | Golinsky, Jr. | 482/109 |
| 4,722,523 | 2/1988 | Yang | 482/108 |
| 4,913,421 | 4/1990 | Bachman | 482/93 |
| 4,986,536 | 1/1991 | Zane | 482/105 X |
| 5,121,925 | 6/1992 | Blundo | 482/109 X |

*Primary Examiner*—Richard J. Apley
*Assistant Examiner*—John Mulcahy
*Attorney, Agent, or Firm*—Arthur F. Zobal

[57] ABSTRACT

The angled bar is formed by two bar portions extending in directions relative to each other to form an angle between 135° and 160°. Weights are attachable to an end of one of the bar portions. A second angled bar similar to the first angled bar but shorter in length may be coupled to the first angled bar to form an assembled bar with weights located at opposite ends.

3 Claims, 1 Drawing Sheet

FOREARM WORKOUT BAR

BACKGROUND OF THE INVENTION

Field of the Invention

The present invention relates to weight training equipment, and in particular, to an angled workout bar.

Description of the Prior Art

Many sporting activities involve extensive use of the wrists and forearms of an athlete engaged in the sporting activity. Baseball players, golfers, and players of racquet sports such as tennis and racquetball use their wrists and forearms to stroke a ball. Gymnasts use their wrists and forearms to perform a variety of maneuvers, and other sports such as motorcross, karate, and weightlifting require considerable wrist and forearm strength. Therefore, improvement of the strength of an athelete's wrists and forearms should improve the athelete's ability to perform his or her sport.

Muscle developing devices for strengthening muscles in the wrists and forearms typically allow an exerciser to perform exercises that only strengthen specific muscles in the wrists and forearms. A straight bar with dumbbell weights can be used to perform wrist curl exercises to strengthen specific muscles in an exerciser's wrists, however, the straight bar with weights cannot be used to perform a variety of wrist and forearm strengthening exercises since the straight bar with weights is suited more for general body building exercises. Compressible hand-held devices, such as spring handgrips, also enable an exerciser to develop specific muscles in the exerciser's wrists and forearms. These compressible hand-held devices, however, also cannot be used to perform a variety of wrist and forearm strengthening exercises. What is needed, therefore, is a device that can be used to perform a variety of exercises that fully develop the wrist and forearm muscles of an exerciser using the device.

SUMMARY OF THE INVENTION

It is an object of the invention to provide an apparatus for performing weight training exercises, specifically, a variety of exercises for fully developing wrist and forearm muscles.

In one embodiment, the bar is formed by two portions extending in directions relative to each other to form an obtuse angle between 135° and 160°. Securing means is provided for securing a weight near the end of one of the sections.

In the preferred embodiment, one portion is longer than the other and the angle is about 155°.

In another embodiment, a second bar is provided similar to the first bar but shorter in length. Coupling means is provided for removably coupling the two bars together to form an assembled bar with the weight securing means located at opposite ends.

Either of the two component bars may be used by an exerciser to perform a variety of exercises, particularly exercises that strengthen wrists and forearm muscles. For example, the bar may be used to perform wrist curls, reverse wrist curls, radial and ulnar flexion exercises and wrist pronation and supination exercises. Further exercises may also be performed with the assembled bar, including triceps extension exercises, bicep curl exercises and military press exercises.

DESCRIPTION OF THE PREFERRED EMBODIMENT

Figure 1:
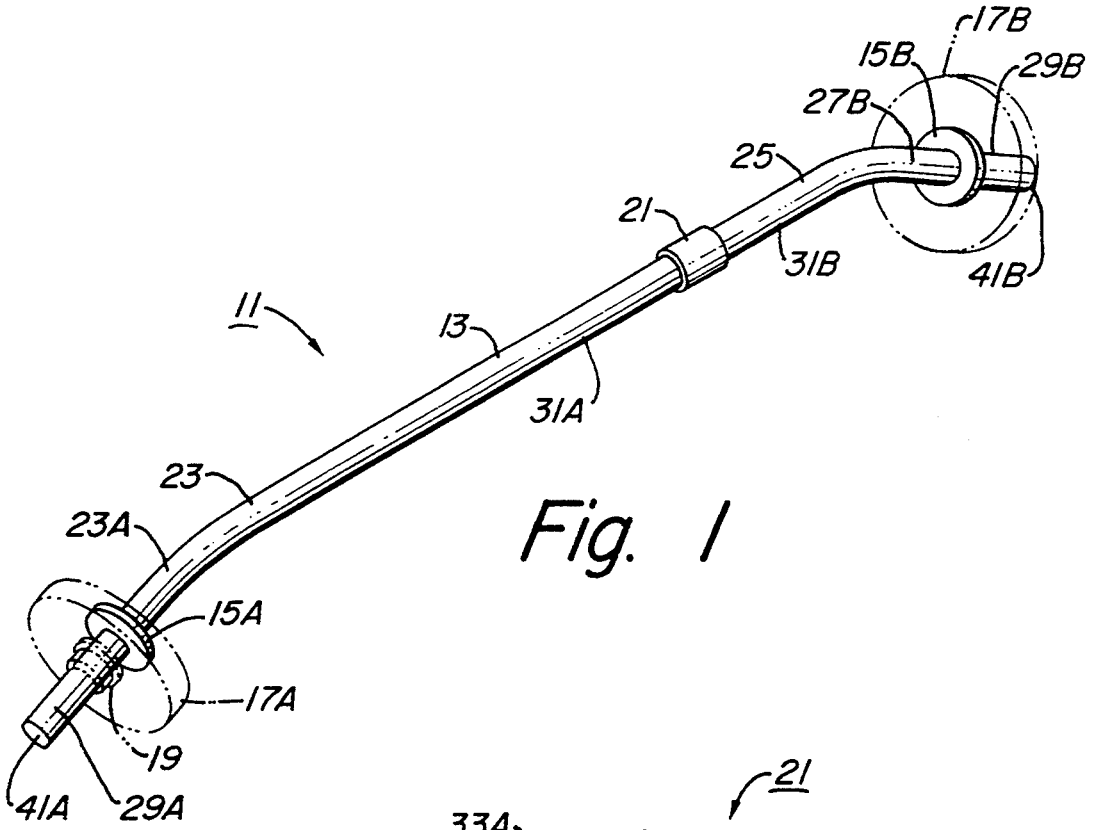
FIG. 1 is a perspective view of two component bars coupled together to form an assembled bar.

Referring now to FIG. 1, there is shown an assembled weight bar 11 formed by two component bars 23 and 25 coupled together. The bars 23 and 25 have washers 15A, 15B integrally coupled thereto respectively for receiving weights 17A, 17B located against the washers 15A, 15B and held in place by annular retaining caps 19. The bars 23 and 25 are removably coupled together at a coupling joint 21. The assembled weight bar 11 may be employed to perform specific exercises or each of the bars 23, 25 may be used to perform other specific exercises.

Each of the bars 23, 25 is ruggedly constructed, preferably being formed of steel. Each of the bars 23, 25 has angled portions 27A, 27B which extend between the end portions 29A, 29B and straight grip portions 31A and 31B. The grip portion 31A of bar 23 is longer than the grip portion 31B of bar 25.

Figure 2:
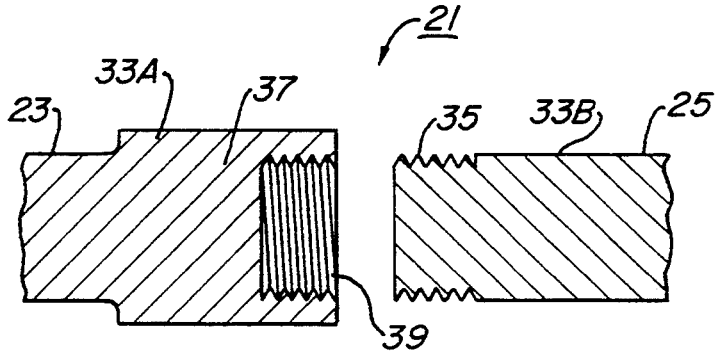
FIG. 2 is an enlarged cross-section view of the coupling joint of the two angle bars.
Figure 3:
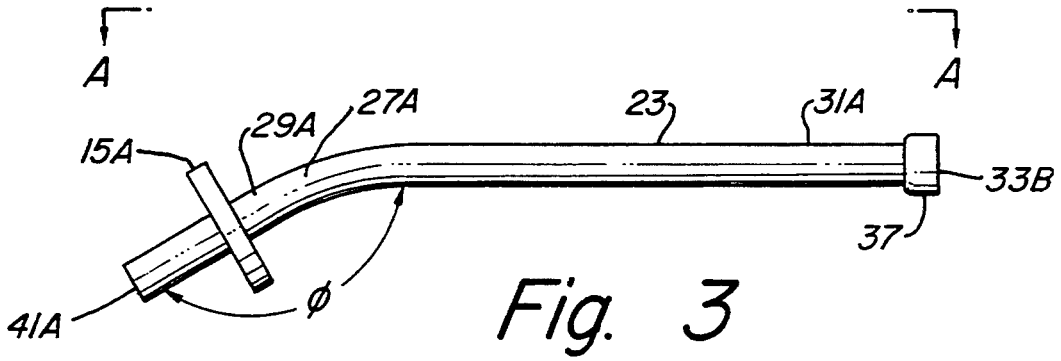
FIG. 3 is a side view of the long angled bar section of the current invention.

As shown in FIG. 2, the coupling joint 21 is formed by coupling ends 33A, 33B of the long and short angled bar sections 23, 25. In a preferred embodiment, one coupling end 33B has a threaded end 35 and the other coupling end 33B has a flared section 37 in which a threaded receptacle 39 is formed. The coupling ends 33A, 33B are removably coupled by screwing the threaded section 35 into the treaded receptacle 39. The treaded sections 35 and 39 may be formed on the ends of bars 23 and 25 respectively if desired. The washers 15A, 15B are located about and are integrally coupled to the end portions 29A, 29B, respectively, bars 23 and 25. The washers 15A, 15B provide support for the weights 17A, 17B when the weights 17A, 17B are located on the bars 23 and 25. Sufficient space is provided between the washers 15A, 15B and the ends 41A, 41B, respectively, so that a sufficient number of weights 17A, 17B and the retaining caps 19 may be located on the end portions 29A, 29B adjacent the washers 15A, 15B.

The weights 17A, 17B are conventional annular weights having a centrally located aperture extending therethrough for receiving the bars. A single weight or plural weights may be located on each end portion 29A, 29B. The retaining caps 19 are a conventional annular member having a centrally located aperture extending therethrough through which an end portions 29A, 29B of the bar 23 and 25 may extend, and having retaining means for gripping the bars. In a preferred embodiment, the retaining caps 19 are fastened to the end portion 29A, 29B of the bars with a bolt that extends through the retaining caps 19 transverse to the bars. The bolts may be tightened against the bars to secure the retaining caps 19 on the bars.

The angled portions 27A, 27B of the bars 25 and 23 are formed by bending the bars by a conventional process, for example by heating the bar at the position to be bent, and bending the heated bar. The bar is bent so that the angled portions 27A, 27B extend at a desired angle theta relative to the grip portions 31A and 31B for example between 135° and 160°. Preferably the angle theta is about 155°. Bar portions 27A and 31A of bar 23 each are straight over a given distance and are located on a given plane A—A. Similarly, bar portions 27B and 31B of bar 25 each are straight over a given distance and are located in a given plane.

The assembled bar of FIG. 1 and the component bars 23 and 25 offer exercise advantages over a conventional straight weight bar. The angled portions 27A, 27B of the bar 11 enable an exerciser to perform certain exercises that cannot be performed with a conventional straight weight bar. For example, exercises may be performed which require the exercisers to rotate the bar 11 in order to move the weights 17A, 17B about the axis of the grip portion. Furthermore, it is believed that the angled portions 27A, 27B of the individual bars 23 and 25 increase the effectiveness of certain exercises that may be performed using a conventional straight weight bar by requiring the exertion of the extra effort to perform the exercises.

In a preferred embodiment, the bars 23 and 25 are formed of steel, and each has a diameter of one inch. The long section 23 has a total length of 21½ inches and the short bar section 25 has a total length of 14.5 inches. The washers 15A, 15B are formed of ¼ inch thick steel and have a center aperture slightly greater than the diameter of the bars. The washers 15A, 15B are welded to the bars 23 and 25 between 2½ and 4 inches inwards from the ends 41A, 41B of the bars.

The weight bars 23 and 25 are especially useful for performing exercises for strengthening an exerciser's wrists, forearms, and arms. Supination and pronation wrist exercises may be performed using either the long or short angled bar section 23 or 25, when separated from each other. The exerciser grasps the grip portion 31A or 31B of bar 23 or 25 with one hand so that the bar section extends away from the exerciser to the weights 19A or 19B, which are angled downwards from the center grip portion. More effort is required to perform the exercise the further the exerciser grasps the center portion 31 from the weight. The exerciser rotates the bar section by rotating his or her wrist in one direction, thereby causing the weights to be rotated upward as the angled portion of the bar is rotated. The exerciser then returns the weights to their initial downward position by slowly rotating his or her wrist back to its initial position. The exerciser may rotate his or her wrist from side to side to rotate the bar clockwise and counterclockwise from its initial position.

Radial and ulnar flexion exercises for strengthening wrists and forearms may be performed with the long angled bar section 23. An exerciser holds the bar section 23 along the center portion 31B in one hand with the palm of the hand facing downwards and the exerciser's arm by his or her side. Again, more effort is required to perform the exercise the further the bar is grasped from the weights. The bar section 23 is held extending outward away from the exerciser so that the weights are angled downward and are located away from the exerciser. The bar section 23 is held extending outward in front of the exerciser to perform a radial flexion exercise, and is held extending outward in back of the exerciser to perform an ulnar flexion exercise. The exerciser lifts the weights by bending his or her wrist to force the bar 23 upward. The exerciser then slowly returns the bar 23 to its initial position.

An exerciser may perform wrist curls by grasping an angled bar section 23 or 25, when separate from each other, under the center portion 31A or 31B with one hand so that the palm of the exerciser's hand faces upward. The bar section 23 or 25 is held so that the weights are angled downward. The exerciser then lifts the angled weights and the bar by curling his or her wrists. The exerciser then slowly releases the bar 23 or 25 to its initial position by uncurling his or her wrists. Reverse wrist curls are performed in a similar manner except that the bar 23 or 25 is grasped with the exerciser's palm facing downward, and the bar is lifted by bending the wrist backward.

The bar sections 23, 25 may be coupled together to form the complete bar 11 to perform other exercises. For example, triceps extensions can be performed by an exerciser locating the bar 11 behind the exerciser's neck and lifting the bar 11. Bicep curls can be performed by an exerciser holding the bar 11 waist high and pulling the bar towards his or her chest. Front and back military press exercises can also be performed with the bar 11, as well as many other conventional weightlifting exercises.

The foregoing disclosure and showings made in the drawings are merely illustrative of the principles of the invention and are not to be interpreted in a limiting sense.

It is claimed:

1. An apparatus for use for exercise purposes, comprising:

a bar having a given length and first and second opposite ends, said bar being formed by first and second non-separable portions joined together at an intermediate portion and extending in directions relative to each other in a given plane to form an angle between 135 degrees and 160 degrees, securing means for use for securing a weight to said first portion near said first end of said bar, coupling means at said second end of said bar for use for coupling said bar to another bar, said first portion being substantially straight from said first end to said intermediate portion and said second portion being substantiality straight from said second end to said intermediate portion, the length of said second portion being greater than the length of said first portion.

2. The apparatus of claim 1 further comprising:

said bar is defined as a first bar, a second bar having first and second opposite ends, said second bar being formed by first and second portions joined together at an intermediate portion and extending in directions relative to each other in a given plane to form an angle between 135° and 160°, securing means for use for securing a weight to said first portion of said second bar near said first end of said second bar, said second bar having coupling means at said second end of said second bar such that said coupling means of said first and second bars may be used to removably couple said first and second ban together.

3. An apparatus for use for exercise purposes, comprising;

a bar having a given length and first and second opposite ends, said bar being formed by first and second non-separable portions joined together at an intermediate portion and extending in directions relative to each other in at given plans to form an angle of about 155°, said first portion being substantially straight from said first end to said intermediate portion and said second portion being substantially straight from said second end to said intermediate portion, the length of said second portion being greater than the length of said first portion, a washer located around and secured to said first portion of said bar near said first end for use for securing a weight to said first portion of said bar, and threaded means at said second end of said bar for use for coupling said bar to another bar.

* * * * *